US010490375B2

(12) United States Patent
Thompson et al.

(10) Patent No.: US 10,490,375 B2
(45) Date of Patent: Nov. 26, 2019

(54) INSULATING SWITCH ASSEMBLY

(71) Applicant: Altec Industries, Inc., Birmingham, AL (US)

(72) Inventors: Jesse L. Thompson, Shepherdsville, KY (US); David Bryon Fuller, Forest City, MO (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 15/851,079

(22) Filed: Dec. 21, 2017

(65) Prior Publication Data

US 2019/0198273 A1 Jun. 27, 2019

(51) Int. Cl.

| | |
|---|---|
| ***H01H 45/02*** | (2006.01) |
| ***H01H 23/04*** | (2006.01) |
| ***H01H 13/04*** | (2006.01) |
| ***H01H 45/14*** | (2006.01) |

(52) U.S. Cl.

CPC ..... *H01H 45/02* (2013.01); *H01H 13/04* (2013.01); *H01H 23/04* (2013.01); *H01H 45/14* (2013.01)

(58) Field of Classification Search

CPC ..... H01H 23/30; H01H 19/635; H01H 2021/225; H01H 23/143; H01H 3/20; H01H 13/023; H01H 2221/03; H01H 2221/044; H01H 71/02; H01H 9/22; H01H 9/287; H01H 9/32; H01H 9/286; H01H 61/02; H01H 13/04; H01H 13/14; H01H 23/04; H01H 13/10; H01H 9/02

USPC ..... 200/333, 339, 334

See application file for complete search history.

(56) References Cited

U.S. PATENT DOCUMENTS

| | | | | |
|---|---|---|---|---|
| 3,071,659 A | | 1/1963 | Kimball | |
| 3,370,143 A | | 2/1968 | Barney | |
| 4,321,443 A | * | 3/1982 | Piber | H01H 21/025 200/276 |
| 5,769,209 A | * | 6/1998 | Massey, III | H01H 23/025 200/330 |
| 8,089,014 B2 | * | 1/2012 | Maeda | H01H 13/06 200/302.1 |
| 2010/0265017 A1 | * | 10/2010 | Cueto | H01H 50/326 335/170 |

OTHER PUBLICATIONS

American National Standard for Vehicle-Mounted Elevating and Rotating Work Platforms; Nov. 3, 1969; American National Standards Institute, Inc.; New York, New York.

* cited by examiner

*Primary Examiner* — Ahmed M Saeed

(74) *Attorney, Agent, or Firm* — Erise IP, P.A.

(57) ABSTRACT

An insulating switch assembly is disclosed. The insulating switch assembly provides electrical insulation between a user and highly charged electric components by employing highly-resistive or nonconductive material. The insulating switch assembly also distances the user from the electrical components by increasing the distance from the user input device and electric components. The user of the insulating switch assembly is provided layers of electrical insulation.

20 Claims, 4 Drawing Sheets

INSULATING SWITCH ASSEMBLY

BACKGROUND

1. Field

Embodiments of the invention are broadly directed to electrical insulation of a user input device. More specifically embodiments of the invention relate to a switch that may comprise electrically highly-resistant material providing layers of insulation between a machine operator and electrically energized machine components.

2. Related Art

Utility workers utilize a utility vehicle to reach inaccessible locations. The utility vehicle generally includes a boom with a utility platform. The utility worker stands in the elevated utility platform while performing a task. Electric utility workers typically use a utility vehicle to access overhead electric power lines and electric power components for installation, repair, or maintenance. The utility platforms utilized by electric utility workers are highly insulated so as to prevent the discharge of electricity through the utility vehicle, and especially through the utility worker.

A boom truck performing utility work may be in danger of contacting electrified components thus electrifying the boom and conducting the electricity through the electrical system of the vehicle. When this occurs, the operator of the boom, any utility worker in the bucket, and a worker in or near the vehicle may be in danger of electric shock. The electrical system may conduct the electricity as well as other conductive vehicle components. To combat this, insulated equipment is used in the prior art.

The high voltage from the power lines may be conducted through the electrical system of the vehicle. Many of the electrical switches on a vehicle place the user in close proximity to the electrical equipment that may conduct the high levels from the power lines to the switch. Any person using the switch may be in danger of electric shock.

SUMMARY

Embodiments of the invention solve these problems by providing layers of insulation between electronic components and an operator. An insulating switch assembly utilized by the operator may be formed of, or at least one surface coated or covered in, a highly-resistant material. A highly-resistant material is a material that is resistant to the flow of electricity, such as fiberglass, silicon, porcelain, glass, rubber, and nonconductive polymers. The highly-resistant material may also extend to other components in contact with the insulating switch assembly. This may separate the operator from electrically charged components. The insulating switch assembly may also separate the user from the electrically charged components by providing space between a user contact point of the insulating switch assembly and the electrically charged components.

A first embodiment is directed to an insulating switch assembly comprising an insulating switch, a switch mounting plate, a switch contactor housing, an insulating linkage, and an insulating linkage housing, the insulating switch and insulating linkage comprising highly-resistive material on at least one side. The insulating switch assembly further comprising electrical terminals disposed on one side of the switch contactor housing accessible on at least one side and at least one insulating linkage configured to translate an insulating switch movement and at least partially disposed within the switch contactor housing. The at least one insulating linkage at least partially disposed within the at least one insulating linkage. The insulating switch assembly separating a user contact point from the electrical components by at least the insulting switch and the insulating linkage.

A second embodiment is directed to an insulating switch assembly comprising an insulating switch, a switch contactor housing, and an insulating linkage, the insulating switch and the insulating linkage comprising electrically highly-resistive material on at least one side. The insulating switch assembly further comprising electrical terminals disposed in the switch contactor housing and accessible on at least one side of the switch contactor housing. The insulating linkage configured to link the insulating switch and an electrical contact and to translate an insulating switch movement. The insulating linkage being disposed within the switch contactor housing. The insulating switch assembly separating a user contact point from the electrical components by at least the insulting switch and the insulating linkage.

A third embodiment is directed to an insulating switch assembly comprising an insulating switch, a switch contactor housing, and an insulating linkage, the insulating switch and the insulating linkage comprising electrically highly-resistive material on at least one side. The insulating linkage configured to link the insulating switch and an electrical contact translating a movement of the electrical switch. The insulating linkage at least partially disposed within the switch contactor housing. The insulating switch assembly separating a user contact point from the electrical components by at least the insulting switch and the insulating linkage.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF DRAWINGS

Embodiments of the invention are described in detail below with reference to the attached drawing figures, wherein.

Figure 1:
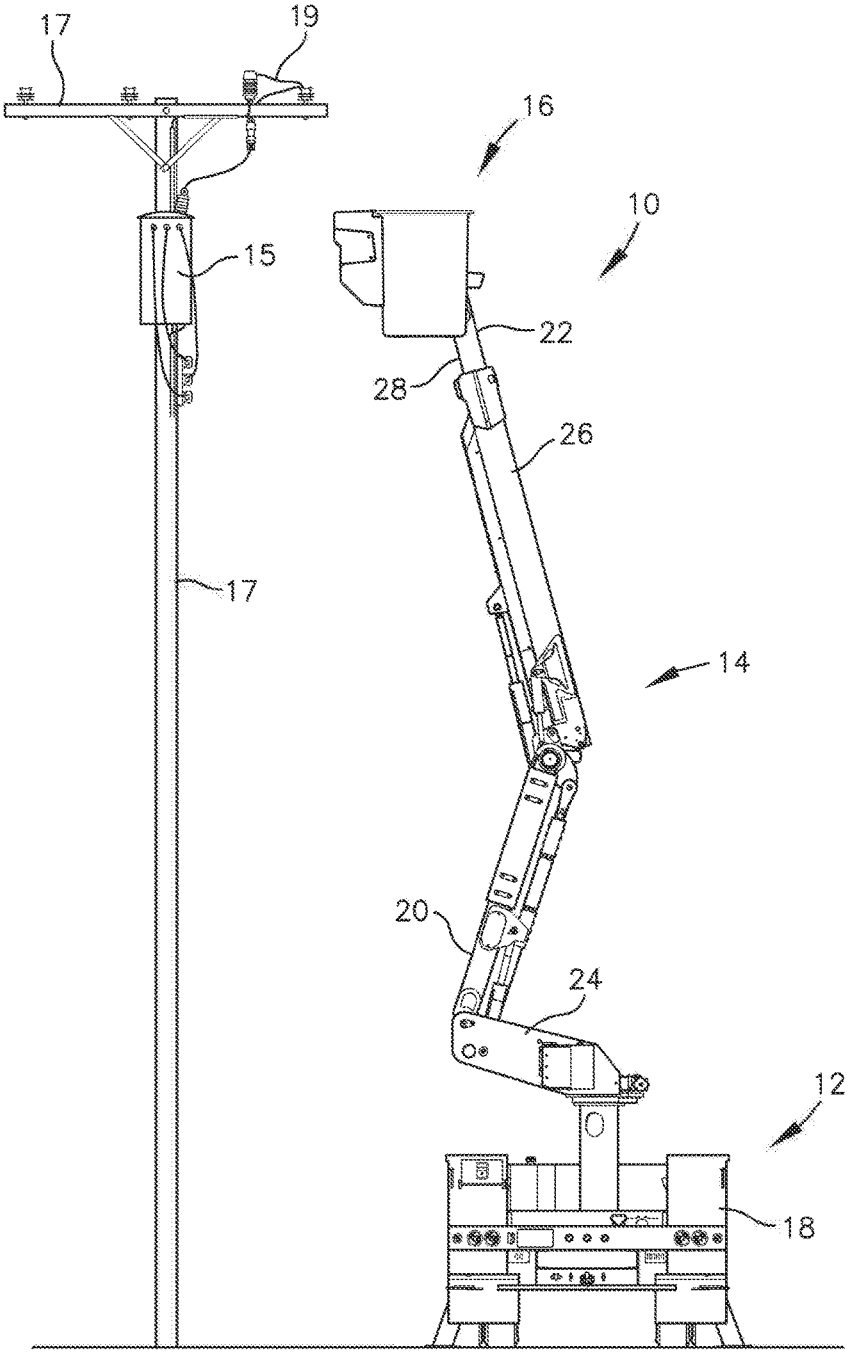
FIG. 1 depicts a rear view of an aerial device in embodiments of the invention.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

An aerial device 10, constructed in accordance with various embodiments of the invention, is shown in FIG. 1. The aerial device 10 generally comprises a structural base 12 with a boom assembly 14 rotatably mounted thereto. A utility platform assembly 16 is disposed on the boom assembly 14 to provide the aerial platform assembly 16 for the accomplishment of a task by a utility worker. In embodiments of the invention controls may be disposed in the utility platform assembly 16 for controlling the boom assembly 14. The aerial device 10 may be controlled to allow a user access to a transformer 15 and any part of the pole assembly 17, power lines 19, or any tool or part attached to the pole assembly 17.

The structural base 12 of the aerial device 10 is a selectively stabilized platform. In embodiments of the invention, the structural base 12 may be a utility truck 18 (as illustrated in FIG. 1), a crane base, an oilrig, an earth-working machine, or a fixed structure. The structural base 12 provides stability and a counterweight to a load being supported by the boom assembly 14. The structural base 12 also provides a hydraulic power system, pneumatic power system, electrical power system, or other system (not illustrated) that powers the movement of the utility platform assembly 16.

The boom assembly 14 broadly comprises an outer boom section 26 and at least one inner boom section 28. The boom assembly 14 presents a proximal end 20 and a distal end 22. The proximal end 20 is rotatably and/or pivotably secured to a boom turret 24 of the structural base 12. The at least one inner boom section 28 is at least in part disposed within the outer boom section 26 assembly. The at least one inner boom section 28 telescopes to extend or retract into the outer boom section 26 assembly. All boom operations as well as some structural base operations may be operated by controls disposed in the utility platform assembly 16.

Figure 2:
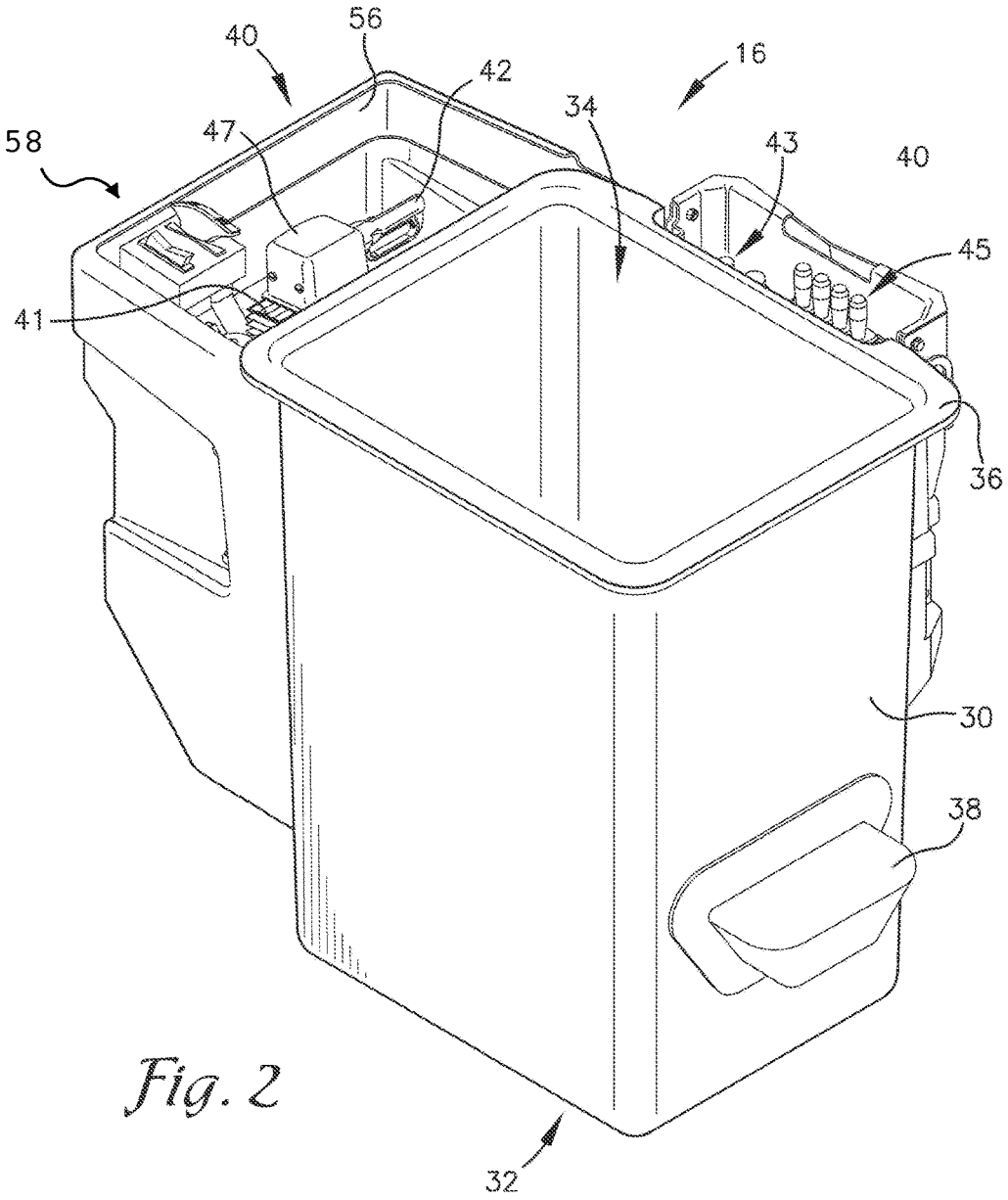
FIG. 2 depicts a perspective view of the aerial device of FIG. 1, which includes controls and an insulating switch assembly.

The utility platform assembly 16, as best illustrated in FIG. 2, provides an elevated surface from which at least one utility worker can perform a task. Embodiments of the utility platform assembly 16 comprise four bucket sidewalls 30 and a bucket floor 32 that collectively form a cavity 34. The utility platform assembly 16 may also present a bucket lip 36 along a top portion of at least one bucket sidewall 30. The utility platform assembly 16 may further comprise a step 38 and/or a door (not illustrated) in at least one of the bucket sidewalls 30 to allow for ingress and egress of the utility worker. The utility platform assembly 16 may also comprise a handrail (not illustrated).

The four bucket sidewalls 30 and the bucket floor 32 of the utility platform assembly 16 form the cavity 34. The four bucket sidewalls 30 may be unitary, i.e. formed of a single monolithic structure, or they may be coupled together. The transition between successive bucket sidewalls 30, and/or between the bucket sidewalls 30 and the bucket floor 32, may be rounded or arcuate. In some embodiments, the utility platform assembly 16 presents a horizontal cross-section that is substantially rectangular. Thus, two of the opposing bucket sidewalls 30 may have a greater width than the other two opposing bucket sidewalls 30. In other embodiments, the utility platform assembly 16 presents a horizontal cross-section that is substantially square. Other embodiments of the utility platform assembly 16 may be other shapes about the horizontal cross-section, such as an ellipse, a circle, a D-shape, a triangle, a trapezoid, a rhombus, or other quadrilateral. The shape of the cross-section of the bucket may vary along the height of the bucket and the bucket shape may be optimized to perform a given function. The bucket may be designed for one or multiple workers. The workers may be separated by a structure for safety or may be contained within the same cavity 34, as depicted in FIG. 2.

In embodiments of the invention, the utility platform assembly 16 further comprises a set of upper boom controls 40, as best illustrated in FIG. 2. The set of upper boom controls 40 are configured to be manipulated by the operator standing in the utility platform assembly 16 so as to move the utility platform assembly 16 and/or the boom assembly 14 to a desired location and configuration. In embodiments, the set of controls 40 utilize hydraulic power that is supplied in the form of a hydraulic fluid by a set of hydraulic lines (not illustrated).

The set of upper boom controls 40 allows the operator to move the boom assembly 14 from within the utility platform assembly 16. The operator in the bucket has a better vantage point to know where and how to position the boom assembly 14 as opposed to the operator on the ground. Additionally, the set of upper boom controls 40 promotes efficiency by allowing the operator to directly control the movement of the boom assembly 14. In embodiments of the invention, an assistant operator (not illustrated) can access a set of lower boom controls (not illustrated) for the duration of the operator being in the utility platform assembly 16. This provides a safety backup to allow the assistant operator to remove the operator from a dangerous situation should the operator become incapacitated or there be a failure in the set of upper boom controls 40. The set of upper boom controls 40 may utilize the same or a different mechanism from the set of lower boom controls.

The set of upper boom controls 40 comprises a dash cover 41 and at least one input 43, as best illustrated in FIG. 2. In various embodiments of the invention, the input 43 can be a valve handle 45, an insulated joystick assembly 42, a button (not illustrated), an insulating switch assembly 58, or a combination thereof. As depicted in FIG. 2, a combination of two insulating switch 58 embodiments is used. The dash cover 41 is generally flat or arcuate and presents at least one opening. Each of the at least one opening is situated around each of the at least one input 43. The dash cover 41 may additionally contain written instructions and safety information.

The dash cover 41 may include a joystick mount 47 that protrudes upward and/or outward from the dash cover 41. The joystick mount 47 allows the insulated joystick 42 to be positioned horizontally relative to the utility platform assembly 16. The horizontal orientation of the insulated joystick 42, as illustrated in FIG. 2, provides a more natural gripping orientation for the user and is less likely to snag on other debris and equipment. The joystick mount 47 may provide a stable platform relative to which at least a portion of the insulated joystick 42 is configured to move such that the user can input desired movement (and other command) information.

Though the insulating switch assembly 58 may be located in the utility platform assembly 16 as depicted in FIG. 2, the insulating switch assembly 58 may be located outside the utility platform assembly 16, in the utility vehicle 18 cab, in a control box on the utility vehicle 18, or in a remote-control device. The switch may control any electrical, mechanical, or hydraulic functions in or on the utility vehicle 18 including in the cab on the utility vehicle 18, on the boom, in the bucket, or any tool used that may be electrically, mechanically, or hydraulically connected to the system.

The insulating switch assembly 58 may be useful in protecting the user from normal electric current at any time during use. The extra levels of insulation provided by the insulating switch provides much greater levels of protection in the event that any part of the boom assembly 14, utility platform assembly 16, or other component of the overall aerial device 10 or associated systems described above come in contact with a high voltage energy source such as the transformer 15, or the power lines 19. The insulating switch assembly 58 is design such that the user is separated from high voltage by insulated material and air space protecting the insulating switch assembly user.

The insulating switch assembly 58 creates insulation from the user and the electrical components by creating a gap of space and air between the user and the components. The gap between two terminals is referred to as a spark gap. The greater the distance between the two terminals the more power in needed for a spark to cross the gap. Therefore, increasing the distance (space) and air (resistive insulator) between a user and the electrically charged or conductive components reduces the likelihood of the user being shocked. The gap may be any size, such as in the range of at least 0.25 inches, 0.25 inches to 3.0 inches, 1.0 to 2.0 inches, or some other range. The gap may be created between or within any components or parts of the insulating switch assembly 58.

Figure 3:
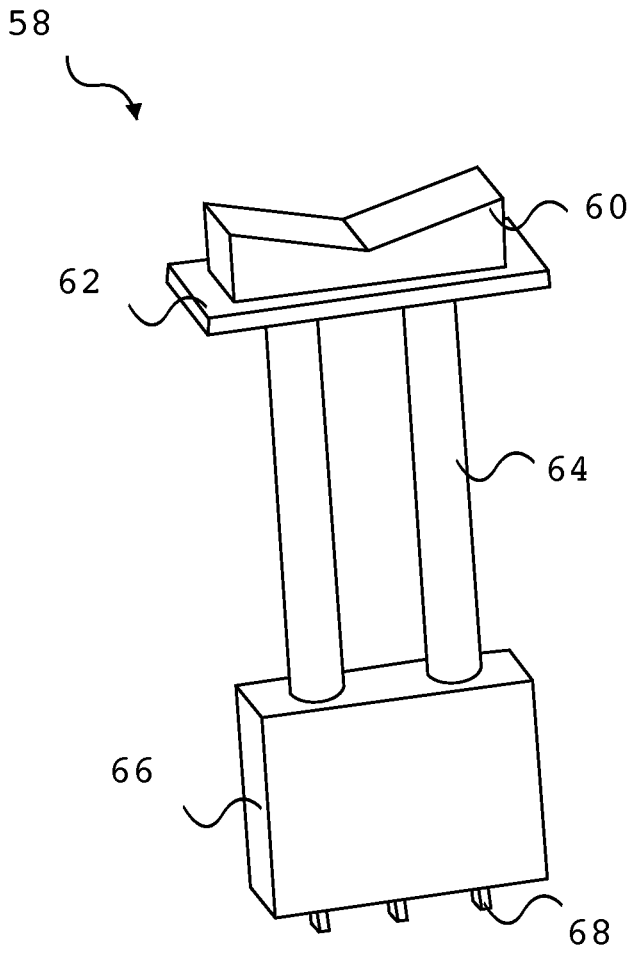
FIG. 3 depicts an exemplary embodiment of an insulating switch assembly.

An exemplary embodiment of the insulating switch assembly 58 is depicted in FIG. 3. The insulating switch assembly 58 may comprise an insulating switch 60, switch mounting plate 62, an insulating linkage 64 comprising a linkage and an insulating linkage housings, a switch contactor housing 66 and electrical terminals 68 that may be wire spade terminals.

The insulating switch 60 depicted in FIG. 3 is a rocker switch. The rocker switch is exemplary only, and may be push button, rotary, slide, toggle, plunger, lever, joystick, single pole single throw, single pole double throw, double pole single throw, double pole double throw, limit switch, or any other type of switch that may be useful changing the operation needed. In the embodiment depicted in FIG. 3 the actuation of the insulating switch 60 is manual.

The insulating switch assembly 58 may be used in automatic applications and as such the insulating switch assembly 58 may be pressure, float, or flow actuated. There may be any number of insulating switch assemblies 58 to perform any number of operations as necessary.

In the exemplary embodiment depicted in FIG. 3, the insulating switch 60 is connected to a switch mounting plate 62. The switch mounting plate 62 may be attached to a plate within the utility platform assembly 16. In this scenario, the only exposed section of the insulating switch assembly 58 is the upper face, sides of the switch mounting plate 62, the insulating switch 60, and possibly any attachments that may attach the insulating switch assembly to the plate within the utility platform assembly 16. It is important to note the exposed faces since the exposed faces are the ones that may come into contact with the user. The exposed faces, other sides or faces, or the component may be covered in or made of electrically highly-resistive or nonconductive material. The insulating switch assembly may be mounted to the plate in the utility platform assembly 16 by other methods and may not have a switch mounting plate 62.

An insulating linkage connects the insulating switch 60 and electrical contacts. In general, electrical contacts are the mechanisms that contact terminals of an electrical switch and allow electricity to flow across a connection. In the embodiment depicted in FIG. 3, the insulating linkage may be a push rod. The push rod may extend from the insulating switch 60 to the interior of the switch contactor housing 66 and may be enclosed by an insulated housing and the switch contactor housing 66. The push rod may translate the movement of the insulating switch 60 to an electrical contact housed within the switch contactor housing 66 enabling the user to change the operation of an electrical, electro-mechanical, or hydraulic component. The insulating linkage 64 comprising push rods and push rod housings may be made of an electrically highly-resistive or nonconductive material to separate the user from the electrical components. At one end the push rod may be in contact with the insulating switch which may be in direct contact with the user. At the other end the push rod may be in contact with the electrical contact enclosed within the switch contactor housing 66. In the assembly presented in FIG. 3 the push rod provides insulation and isolation between the user and the electrical components. Though two push rods are present in the embodiment depicted in FIG. 3, one, two, three, or any amount of push rods may be used depending of the switch capabilities and the function of the insulating switch assembly 58, the number of insulating switches 60, and the functionality of the insulating switch assembly 58.

The insulating linkage 64 may comprise the push rod (visible) and the push rod housing (not visible). The push rod housing may span the distance between the switch mounting plate 62 and the switch contactor housing 66. The push rod housing may be stationary allowing the push rod to translate inside. The push rod housing and the push rod may be coated on at least one side or made of an electrically highly-resistive or nonconductive material. An air gap may be present between the push rod and the push rod housing providing an extra level of isolation and insulation between the electrical components and the user. The push rod housing may be structural in that it provides support between the switch mounting plate 62 and the switch contactor housing 66 or may only provide additional insulation. In embodiments, there may only be push rods and the push rod housing may not be needed.

The insulating switch assembly 58 may have multiple push rods. The push rods may be based on the functionality of the insulating switch 60. The insulating switch 60 may have one, two, three, or more operations. The insulating switch 60 may have multiple channels and the insulating switch 60 may have a switch that changes between functions manually or automatically. The different functions may activate simultaneously depending on the mode of the insulating switch 60. The operations of the insulating switch 60 may be activated by selecting which settings are active in each mode of the insulating switch 60. For example, channel 1 operates vehicle safety lights and channel 4 operates boom safety lights. A secondary switch may lock channels 1 and 4 together so both boom and vehicle lights are simultaneously operable by moving the insulating switch 60 to one setting. The insulating switch 60 may also select the channel that may be operated by other devices. For example, in the full forward position, the boom may be operated. In the full back position, the utility platform assembly 16, or any other component on or connected to the aerial device 10 may be maneuvered. While one operation is performed, the other operations may be locked or controlled by other methods.

The switch contactor housing 66 may be attached to the insulating linkage 64. The push rods may extend inside the switch contactor housing 66. The switch contactor housing 66 may enclose the electrical contact operable by the push rod translation. The electrical contact may electrically couple any of the electrical terminals 68 allowing or preventing electricity to flow through the switch contactor housing 66.

The electrical contact in the switch contactor housing 66 may be mechanical contacts such as rivets, buttons, studs, levers, or any other mechanical contact that may perform the necessary function. The electrical contact may also be an electromechanical relay. Any electrical contact that may conduct electricity from one component to another that may be shielded in a way that separates the user from the electricity may be used.

Though the electrical terminals 68 depicted in FIG. 3 are wire spade terminals, the insulating switch assembly 58 may be used for any function, therefore any connectors such as terminal block, posts, crimp on, insulation displacement, plug and socket, blade, ring and spade, USB, power, radio frequency, DC, phone, or any other connector or electrical terminal 68 that may be useful for the function to be performed may be used. The electrical terminals 68 used for the insulating switch assembly 58 connect to corresponding terminals on the aerial device 10. Since the insulating switch assembly 58 may be used for any purpose, the electrical terminals 68 may be adapted to the component for which the insulating switch assembly 58 is to be used. The electrical terminals 68 on the insulating switch assembly 58 may be male or female, and may be disposed within or protruding from the insulating switch assembly 58 on any side, top, or bottom. The electrical terminals 68 may be accessible on any side, top or bottom.

The insulating switch assembly 58 may be attached to the aerial device 10, or any plate, or panel by any attachment method. The switch mounting plate 62 may be screwed, bolted, riveted, glued, taped, or attached using any adhesive, hook and loop method, or any other method that may be permanent or temporary. The switch mounting plate 62 may not be attached and the insulating switch assembly may be held in place by other methods.

The insulating switch assembly 58 may be easily removable. The insulating switch assembly 58 may be plugged in with no attachments to hold the insulating switch assembly 58 in place and the insulating switch assembly 58 may be held in place by the electrical terminals 68. The insulating switch assembly 58 may also slide into a notch cut to align with the outside surface of the switch contactor housing 66. The removability may allow the user to plug the insulating switch assembly 58 in, perform a function, and remove the insulating switch assembly 58 to ensure that the operation cannot be performed again. The insulating switch assembly 58 may also be mounted by any of the above stated attachments that may be attached to the switch contactor housing 66, or the switch mounting plate 62.

The insulating switch assembly 58 may be mobile. The electrical terminals 68 may be wires of any length allowing the insulating switch assembly 58 to be held in hand and mobile relative the aerial device 10. In this scenario, the electrical wires may also have extra insulation. The insulating switch assembly 58 may be attached to a remote transmitter and the operation signals sent to the aerial device 10, boom assembly 14, utility platform assembly 16, or any device that may be operated by the insulating switch assembly 58.

Figure 4:
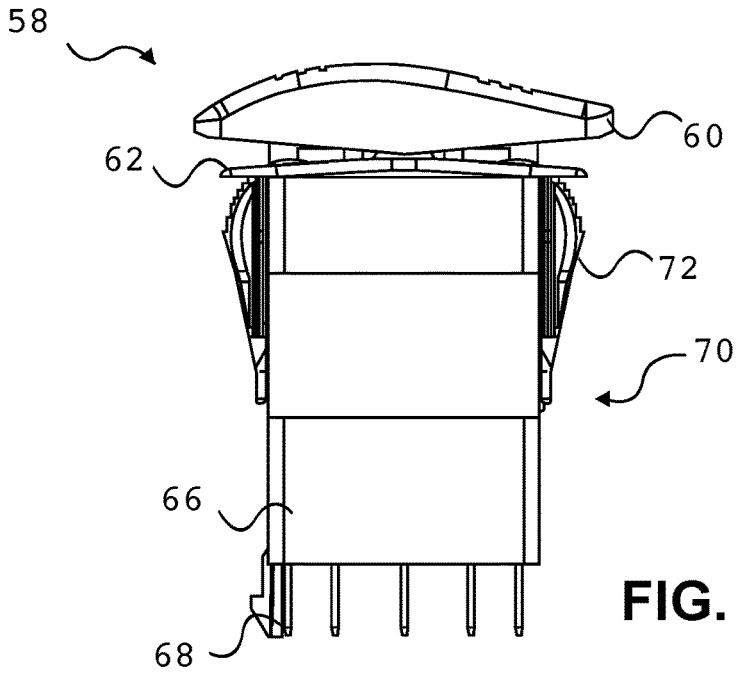
FIG. 4 depicts an exemplary embodiment of an insulating switch assembly with an extended base.

FIG. 4 depicts an exemplary embodiment of the insulating switch assembly 58 that separates the user from the electrical components by extending a base assembly 70 a sufficient amount to separate the user from the electrical contacts by at least 0.25 inches, although the separation may be any amount sufficient to insulate the user from the expected electrical power. The base assembly 70 includes the switch contactor housing 66, electrical terminals 68, electrical contacts, the insulating linkage 64, compressible mounting locks 72, and any other part that may attach the components, or provide the insulating switch assembly 59 with structure or functionality. The insulating switch 60 may be attached to the switch mounting plate 62, and the switch mounting plate 62 may be attached to the top portion of the switch contactor housing 66. The switch contactor housing 66 may enclose all components below the insulating switch 60. The switch contactor housing 66 may be insulated on at least one side with electrically highly-resistive or nonconductive material. The switch contactor housing 66 may also not be in direct contact with any of the electrical equipment thus providing another level of insulation. The switch contactor housing 66 may further provide air space between the housing that may come into contact with a user and the electrically charged components enclosed. The electrically charged components may be mounted in the bottom portion of the switch contactor housing 66 making the switch contactor housing 66 mostly empty space.

In embodiments, the insulating switch assembly 58 may be mounted to a panel made of metal, wood, composite, or any material that may be used in a situation that may need an insulating switch assembly 58. Any method of attaching the insulating switch assembly 58 to the material that is appropriate for the type of material may be used.

Figure 5:
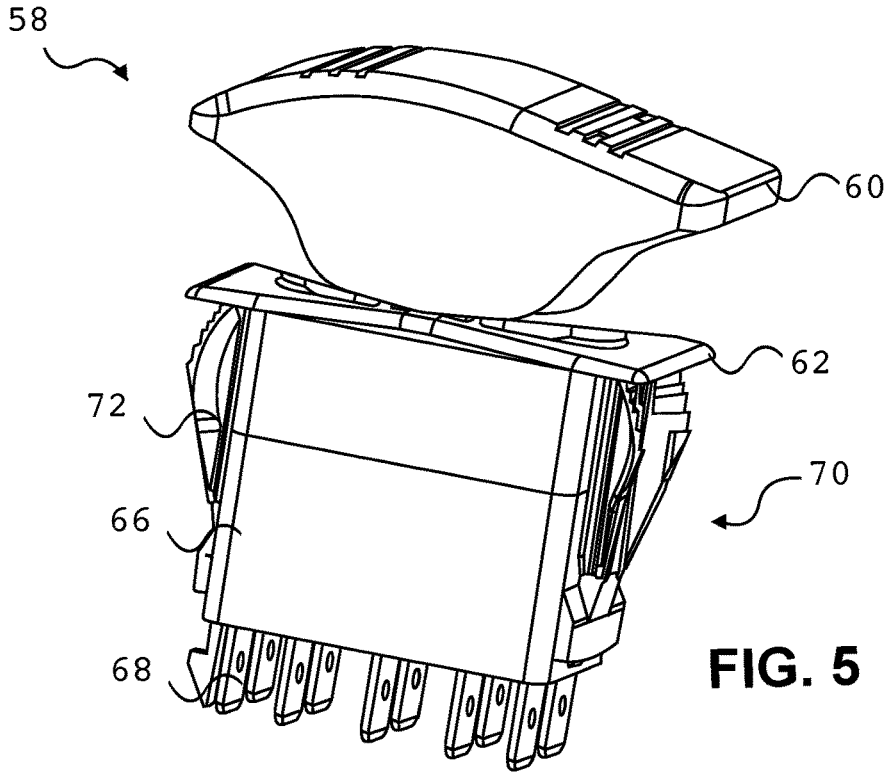
FIG. 5 depicts an exemplary embodiment of an insulating switch assembly with an extended insulating switch.

In embodiments as depicted in FIGS. 4 and 5, the insulating switch assembly 58 may be mounted using compressible mounting locks 72. As the insulating switch assembly 58 is pressed through a panel the compressible mounting locks 72 may compress allowing the insulating switch assembly 58 to move into place, connecting the electrical terminals 68. As the panel moves past the peak of the compressible mounting locks 72, notches protruding from the outer surface of the compressible mounting locks 72 provide a locking mechanism that may restrict the insulating switch assembly 58 from moving due to bumps or vibration. This may allow for easy installation and removal while locking the insulating switch assembly 58 into place.

The compressible mounting locks 72 may be made of a flexible material or a rigid material configured to flex or bend. The compressible mounting locks may be made of or coated in an electrically highly-resistive or nonconductive material.

In the embodiment depicted in FIG. 4, the insulating switch 60 creates a low profile and unobstructed access to other switches knobs or controls that may be mounted on a common control panel. The low profile is combined with the extra benefit of the high insulation provided by the separation from the user and the electrified components created by the extended base assembly 70 and switch contactor housing 66.

The insulating switch assembly 58 creates insulation from the user and the electrical components by creating a gap of space and air between the user and the components. The gap between two terminals is referred to as a spark gap. The greater the distance between the two terminals the more power in needed for a spark to cross the gap. Therefore, increasing the distance between a user and the electrically charged or conductive components reduces the likelihood of the user being shocked.

FIG. 5 depicts an exemplary embodiment of the insulating switch assembly 58 that separates the user from the electrical components by increasing the depth of the insulating switch 60. The insulating switch 60 may be lengthened a sufficient amount to separate the user input area on top of the insulating switch 60 from the switch contactor housing 66 containing the electrically charged components by at least 0.25 inches or any distance sufficient to create a gap that reduces the likelihood of a spark gap. The insulating switch 60 is made of or coated in an electrically highly-resistant or nonconductive material. The insulating switch 60 also provides contours on the upper surface to provide a rough surface for the user to grip. This may prevent the user from touching components that may be electrically charged.

The embodiment depicted in FIG. 5 may slide into place using the compressible mounting locks 72 or by any other attachments or methods as described above. The electronics or electrical contacts or electrical terminals 68 may be standard or any electrical connections or electrical terminals 68 as described above.

The electrical contact housing 66 may be any size necessary to enclose all components and fit into a control box or mount on a control panel. The electrical contact housing 66, as with all insulating switch assembly 58 components, may be custom built or a standard size available for pre-existing parts. Since the insulating switch 60 is providing the separation from the electrical components, the switch mounting plate 62, electrical contact housing 66, base assembly 70, and any other components are not restricted in size and dimension. As an added benefit to the embodiment, the control box or the space behind the control panel may be small. As such, existing electronics or parts may not have to be modified to integrate the insulating switch assembly 58 of the exemplary embodiment depicted in FIG. 5.

The insulating switch 60 depicted in the exemplary embodiment of FIG. 5 may be tall and possibly stand over other instruments on a control panel. This may result in the insulating switch 60 being susceptible to accidental contact from the user. This may result in unwanted activation or damage to the insulating switch 60 or control panel. In this case, it may be more beneficial to user the insulating switch assembly 60 of the exemplary embodiment depicted in FIG. 4.

The insulating switch assembly 58 depicted in FIG. 5, may employ any of the modes of operation as described above as related to any of the embodiments described above. The insulating switch assembly 58 may be mounted in the aerial device 10 cab, on the exterior of the aerial device 58, in a control box, on a control panel, in the utility platform assembly 16, on the boom assembly 14, or on any tool, or part used in combination with the aerial device 10. The insulating switch assembly 58 may be used to perform any function that a switching operation may perform in any of the above described components. The lower profile and adaptable size and dimension of the base assembly 70 of the insulating switch assembly 58 depicted in FIG. 5 may provide an adaptable insulating switch assembly 58 that may be easily integrated into the above stated components.

Embodiments of the insulating switch assembly 58 may be used with any electrical system including, fiber optic, or wired and may meet any industry standards. For example, the application of the insulating switch assembly 58 may be to meet the requirements of ANSI 92.2 for insulating controls. The insulating switch may be required to meet the category C machine in ANSI with an insulating controller. The test is a 40 kV ac test for 3 minutes with a maximum amount of current through the insulating section of the insulating switch assembly 58 being no more than 400 microamperes. Depending on the material used the length of the insulating section may be 2-4 inches. Similarly, embodiments of the insulating switch assembly 58 may meet the allowances for a category E machine that could be rated for 20 kV, 5 kV, 1 kV, and below. The length of the insulating section for the insulating switch assembly 58 may be changed for the different requirements.

The distance from the user contact point of the insulating switch 60 and the electrical contacts may be at least 0.25 inches in some embodiments. Any distance that may be required by the application of the insulating switch assembly 58 may be provided by the insulating switch 60, switch mounting plate 62, insulating linkage 64, and/or the switch contactor housing 66. The distance of 0.25 is exemplary and may be any distance sufficient to reduce the likelihood of a spark jumping the gap and shocking the user. The distance and design may be varied based on the specific need for the application of the insulating switch assembly. For example, the extended insulating switch 60 may be used for lower level requirements and the extended insulating linkage 64 may be used for high voltage requirements.

The insulating components and methods of use provided herein may be used individually or in any combination. The components and methods may also be used with other items and methods such as insulating boom covers. These methods may provide layers of security for operators when used in combination significantly decreasing the potential for injury due to electric shock.

It should be appreciated that, while the above disclosure has been generally directed to the field of aerial devices, embodiments of the invention may be directed to other fields and uses. For example, embodiments of the invention may be used in stationary cranes, antennas, digger derricks, and other equipment that lifts off the ground from a stationary or selectively stationary location.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. An insulating switch assembly, comprising:

an insulating switch;

a switch mounting plate in direct contact with and supporting the insulating switch;

a switch contactor housing;

wherein the insulating switch comprises electrically highly-resistive material on at least one side;

electrical terminals disposed on the switch contactor housing accessible on at least one side of the switch contactor housing;

an insulating linkage extending from the switch mounting plate to the switch contactor housing providing electrical insulation; and at least one insulating pushrod presenting a length and disposed between the insulating switch and an electrical contact, wherein the at least one insulating pushrod comprises electrically highly-resistive material on at least one side, wherein the insulating pushrod is configured to translate along the length of the insulating pushrod in response to a pressing of the insulating switch, wherein an insulating switch user contact point is separated from the electrical contact by at least the insulating switch and the insulating pushrod reducing the likelihood of shocking a user.

2. The assembly of claim 1, wherein the insulating linkage is the switch contactor housing.

3. The assembly of claim 1, wherein at least one of the switch contactor housing, the insulating switch, the switch mounting plate, the insulating pushrod, and the insulating linkage is made of the electrically highly-resistant material.

4. The assembly of claim 3, wherein the electrically highly-resistant material is a polymer.

5. The assembly of claim 1, wherein the electrical terminals are wire terminals.

6. The assembly of claim 1, wherein the insulating switch activates the electrical contact; and wherein the electrical contact is a relay.

7. The assembly of claim 1, wherein the insulating switch controls a plurality of utility platform assembly operations.

8. The assembly of claim 3, wherein the insulating linkage comprises two linkages each insulating an individual push rod.

9. The assembly of claim 1, wherein the insulating switch user contact point is separated from the electrical contact by at least 2 inches reducing the likelihood of an electrical spark crossing a gap and shocking the user.

10. An insulating switch assembly, comprising:

an insulating switch;

a switch mounting plate in direct contact with and supporting the insulating switch;

a switch contactor housing, wherein the insulating switch comprises electrically highly-resistive material on at least one side;

electrical terminals disposed in the switch contactor housing and accessible on at least one side;

an insulating linkage extending from the switch mounting plate to the switch contactor housing providing electrical insulation; and an insulating pushrod presenting a length and configured to link the insulating switch and an electrical contact, wherein the insulating pushrod is configured to translate along the length of the insulating pushrod in response to a pressing of the insulated switch, wherein the insulating pushrod comprises electrically highly-resistive material on at least one side;

wherein an insulating switch user contact point is separated from the electrical contact by at least the insulating switch and the insulating pushrod reducing the likelihood of shocking the user.

11. The assembly of claim 10, wherein the insulating switch is a push button switch.

12. The assembly of claim 10, wherein the insulating switch assembly is configured to withstand 40 kV alternating current for three minutes with a maximum amount of current through the insulating switch being no more than 400 microamperes.

13. The system of claim 10, wherein the switch contactor housing is configured with attachments for holding the insulating switch assembly in place; and wherein the contactor housing comprises electrically highly-resistive material on at least one side.

14. The assembly of claim 13, wherein the attachments are flexible, providing insertion of the insulating switch into the housing in a direction and preventing extraction in an opposite direction, and wherein compression of the attachments allows the insulating switch assembly to be extracted from the housing.

15. An insulating switch assembly, comprising:

an insulating switch;

a switch contactor housing, wherein the insulating switch comprise electrically highly-resistive material on at least one side;

electrical terminals protruding from the switch contactor housing on at least one side, and an insulating linkage configured to link the insulating switch and an electrical contact;

wherein the insulating linkage is configured to translate an insulating switch movement and is at least partially disposed within the switch contactor housing;

wherein the insulating linkage comprises electrically highly-resistive material on at least one side, wherein an insulating switch user contact point is separated from the electrical contact by at least the insulating switch and the insulating linkage reducing the likelihood of an electrical spark crossing a gap and shocking a user, wherein the insulating switch assembly is configured to withstand 40 kV alternating current for three minutes with a maximum amount of current through the switch contactor housing being no more than 400 microamperes.

16. The assembly of 15, wherein the switch contactor housing is configured with attachments for holding the insulating switch assembly in place.

17. The assembly of claim 15, wherein the contact is an electromechanical relay.

18. The assembly of claim 15, wherein the insulating switch assembly controls a plurality of operations.

19. The assembly of claim 15, wherein the insulating switch is a rocker switch.

20. The assembly of claim 19, wherein a rocker switch user contact point and the electrical terminals are separated by at least 0.25 inches reducing the likelihood of an electrical spark crossing the gap and shocking the user.

* * * * *